United States Patent [19]

Davis

[11] 4,294,371

[45] Oct. 13, 1981

[54] SUNDAE DISH

[75] Inventor: Paul Davis, Swampscott, Mass.

[73] Assignee: Sweetheart Plastics, Inc., Wilmington, Mass.

[21] Appl. No.: 111,102

[22] Filed: Jan. 10, 1980

[51] Int. Cl.[3] ..... B65D 1/22

[52] U.S. Cl. ..... 220/4 E; 224/2.5 R

[58] Field of Search ..... 220/4 B, 4 E; 229/2.5 R

[56] References Cited

U.S. PATENT DOCUMENTS

| | | | |
|---|---|---|---|
| 2,986,300 | 5/1961 | Parrish | 220/4 E |
| 2,999,611 | 9/1961 | Paulson | 220/4 E |
| 3,620,403 | 11/1971 | Rump | 220/4 E |
| 3,938,726 | 2/1976 | Holden | 229/2.5 R |
| 4,096,986 | 6/1978 | Florian | 220/2.5 R |
| 4,195,746 | 4/1980 | Cottrell | 220/4 E |

*Primary Examiner*—George E. Lowrance

*Attorney, Agent, or Firm*—Wolf, Greenfield & Sacks

[57] ABSTRACT

A sundae dish having a bottom dish and a cover that are identical. The rim structure of each dish is part male and part female, and each is provided with a locking element. The two parts of the container are self aligning by virtue of their rim structures so that when one is inverted on the other, the locking elements are aligned for convenient locking of the container.

7 Claims, 7 Drawing Figures

SUNDAE DISH

INTRODUCTION

This invention relates to sundae dishes. More particularly the invention comprises a sundae dish which is made up of a base and cover that are identical with one another. Either can function alone as a dish, or two such dishes can be used to provide a closed sundae dish where food is to be eaten off the premises.

One important object of this invention is to provide a sundae dish which may be manufactured in volume inexpensively and which reduces inventory requirements of the establishment using them.

Another important object of this invention is to provide a two piece sundae dish made up of a cover and dish that automatically align and may readily be locked together when the cover is placed on the dish.

Yet another object of the invention is to provide a sundae dish that nests very closely with identical dishes so as to conserve space when stacked.

To accomplish these and other objects, the sundae dish of this invention is made up of two parts, namely, a dish and cover, which are identical with one another. The dish as well as the cover are free of undercuts and yet are designed so that they nest closely with one another but yet may be separated freely. The dish (and cover) is provided with a rim structure which is partly male and partly female in configuration and each part of the rim is provided with its own locking element. When a like dish is inverted on the bottom dish so as to define a cover for it, the male portion of the rim structure of each dish mates with the corresponding female structure of the other part of the container, and the locking elements also register with one another so that the container may be conveniently locked.

These and other objects and features of this invention will be better understood and appreciated from the following detailed description of one embodiment thereof, read in connection with the accompanying drawings.

BRIEF FIGURE DESCRIPTION

DETAILED DESCRIPTION

Figure 1:
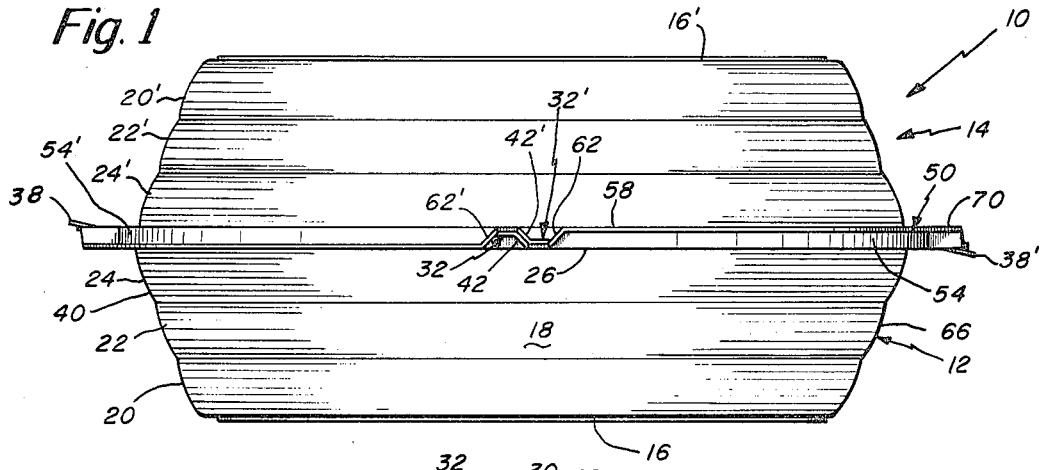
FIG. 1 is a side view of a closed container or sundae dish constructed in accordance with this invention.

The closed container 10 shown in FIG. 1 is composed of two identical parts 12 and 14. As shown part 12 serves as a base or dish for the container and the part 14 serves as its cover. Because the two are identical, only one need be described. The manner in which they cooperate to form a closed container is also described.

The container dish 12 includes a flat bottom wall 16 and a surrounding continuous side wall 18 which is flared gently upward and outward at an angle of approximately 25° with the vertical. The side wall 18 is shown to have a scalloped configuration in the vertical direction so as to form three parallel bowed strips 20, 22 and 24 that encircle the dish. Typically the dish may be made of styrene and have a wall thickness of approximately 0.018″ to 0.025″.

Figure 2:
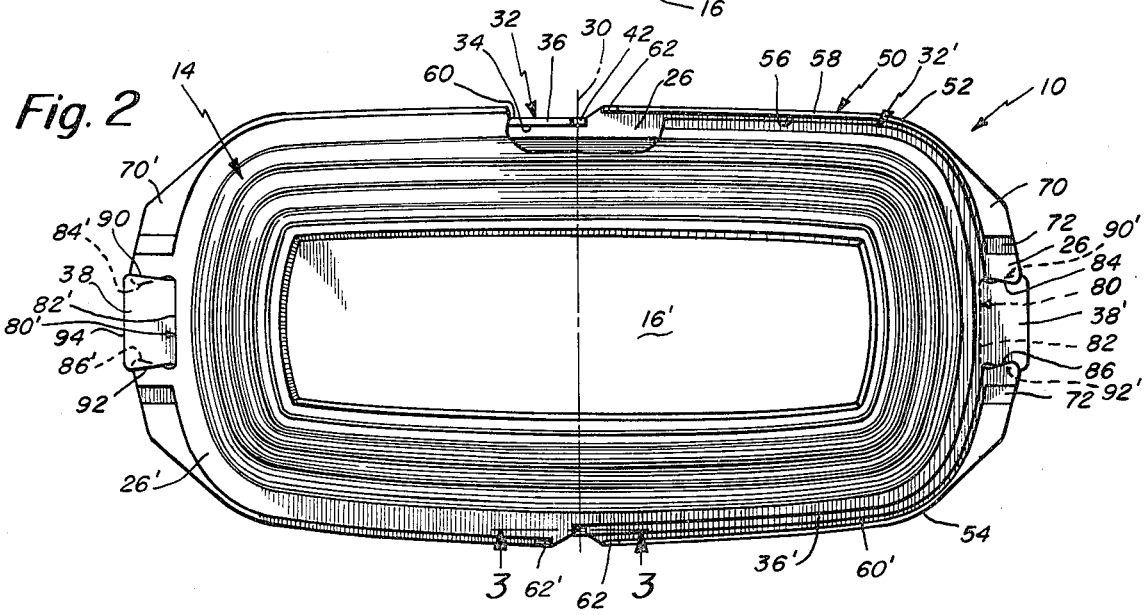
FIG. 2 is a top view of the closed container of FIG. 1 with a section of the cover broken away to show the manner in which the rims of the cover and dish cooperate.
Figure 6:
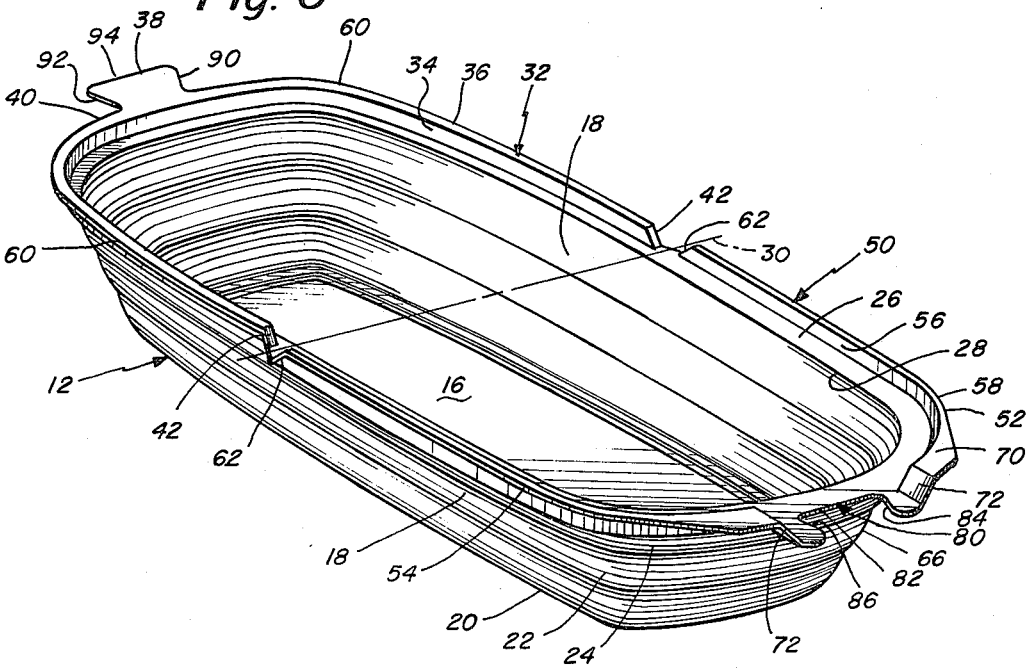
FIG. 6 is a perspective view of the open dish.

A horizontal flange 26 extends outwardly from the top edge 28 of side wall 18, and the flange in turn carries the mating parts of the dish that enable it to register with an identical dish inverted on top of it. Essentially two different rim constructions are provided on the flange 26 on opposite sides of the dividing line 30 shown in FIGS. 2 and 6. On the left side of dividing line 30 as viewed in FIG. 6 the so-called male half of the rim structure is formed while on the right side as viewed in that figure, the female rim structure is provided. The male and female parts each account for substantially half of the total rim structure.

The male rim structure is defined by an uninterrupted bead or lip 32 which extends upwardly from flange 28. The bead includes an inner wall 34 and a horizontal top wall 36 that extends outwardly from the top of the inner wall. The inner surface of wall 34 is uniformly spaced from the edge 28 of the side wall 18, and a tab 38 coplanar with the top wall 36 extends outwardly from that wall at the end 40 of the container.

Each end of the bead 32 is provided with an inclined end wall 42 that slopes generally down from the top wall 36 to the flange 26. As will become apparent from the description below, the end walls 42 are intended to abut against the identical walls of the mating half of the container to form a continuous bead around the full extent of the container made up of the two halves.

The female half of the rim structure is formed by a skirt 50 comprised of two halves 52 and 54. The skirt 50 is composed of an inner wall 56 extending upwardly from the flange 26 and a top wall 58 that extends outwardly from the top of the inner wall. Wall 56 is spaced from the edge 28 of the side wall a greater distance than is the wall 34 of bead 32. In fact, the wall 56 is spaced further from the edge 28 than the outer edge 60 of top wall 36 of the bead. The ends of the skirt 50 adjacent the dividing line 30 are downwardly tapered as suggested at 62 and in the embodiment shown are spaced slightly from the end walls 42 of bead 32.

At the end 66 of the dish 12 the top wall 58 of the skirt widens as shown at 70 and that end of each half of the skirt terminates in a downwardly inclined end wall 72 which merges into the flange 26. This structure serves as a stiffening member for the flange 26 which is enlarged at end 66 of the container so as to provide an area for the formation of a dove-tailed slot 80 in the flange 26. The inclined walls 72 also serve to place the slot in the proper plane to receive the tab of the mating dish as explained more fully below. The slot 80 is defined by inner edge 82 and converging side edges 84 and 86. It may be noted that in the embodiment shown the tab 38 is also generally dove-tailed in shape as defined by its side walls 90 and 92 and end edge 94.

FIGS. 2–5 illustrate the manner in which two identical dishes may be locked together to form a closed sundae dish. For purposes of clarity, in describing the manner in which the containers fit together, the parts of the cover dish 14 are identified by primed numbers to distinguish them from the bottom dish. As shown, the bead 32' of cover 14 rests on the flange 26 of the bottom dish 12 inside the skirt 50. Similarly, the bead 32 of the bottom dish supports the cover 14 by engaging the flange 26' of the cover. The interaction of the bead and skirt on each half of the closed container helps to center the two dishes so that their tabs and slots that form the locking elements of the container are aligned with one another. That is, the dove-tailed slot 80' of the cover 14 is immediately adjacent and in alignment with the tab 38 of the dish 12 and similarly, the tab 38' of the cover 14 is aligned with and overlies the dove-tailed slot 80 of the dish 12. To lock the dish and cover together, it is only necessary to flex the tabs so that they lie within the slot with their side edges overlapping one another. That is, the side edges 90 and 92 of tab 38 of the dish overlap the side edges 84' and 86' of the slot 80', while the edges 90' and 92' of the tab 38' of the cover 14 underlie the edges 84 and 86 of the dish. It will be appreciated that it is unnecessary for both the slot and tab to be dove-tailed. If just one has that shape, the edges will interlock.

Figure 3:
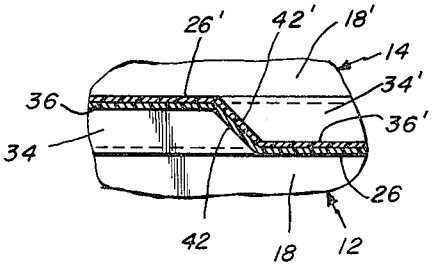
FIG. 3 is a fragmentary cross-sectional view taken along section line 3—3 of FIG. 2.
Figure 4:
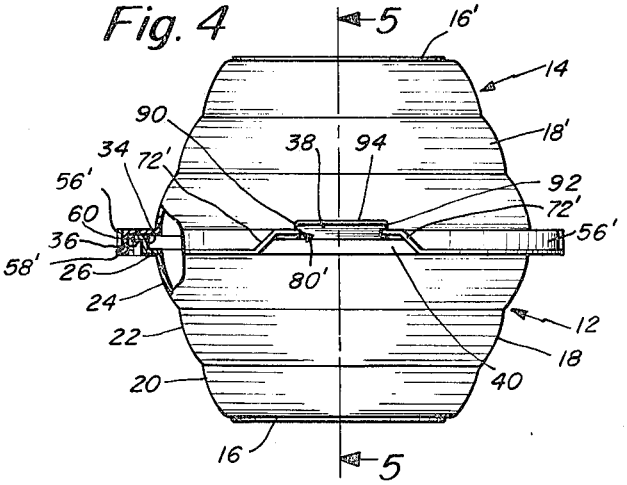
FIG. 4 is an end view of the closed container with sections of the cover and dish broken away to show the manner in which the rims cooperate.
Figure 5:
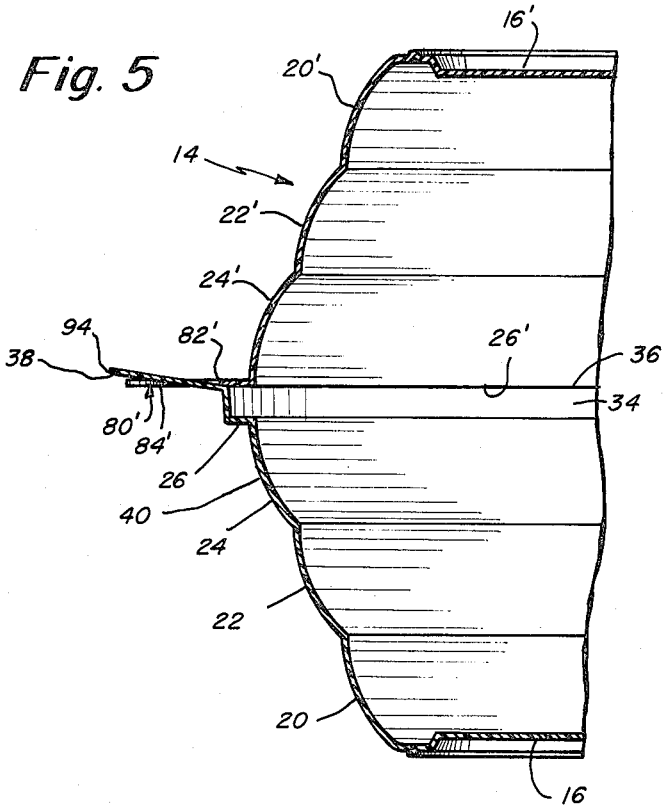
FIG. 5 is a fragmentary cross-sectional view of the closed container taken along section line 5—5 of FIG. 4.
Figure 4A:
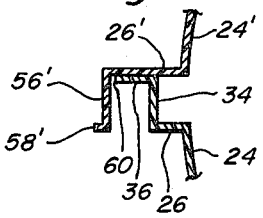
FIG. 4A is an enlarged fragmentary view of the rim structure of the closed container.

In FIG. 3 it will be noted that when the two dishes are closed so as to serve as a covered sundae dish, the end walls 42 of the bead 32 engage the end walls 42' of the bead 32' so as to form a continuous bead about the entire container. The beads along with the skirts that cover them form a dirt barrier so as to protect the contents of the container. The end walls 42 also assist in aligning the dish and cover by preventing the cover and dish from sliding longitudinally with respect to one another. That is, the cover as shown in FIG. 1 cannot move to the left with respect to the base because of the engagement of the end walls 42 and 42'. The cover cannot move to the right with respect to the dish because of the interference with the skirt 50 and the bead 32'.

It should be noted that because of the flare of the side walls of the dish as well as the slight outward inclination of the inner walls 34 and 56 of the bead and skirt and the inclination of the end walls 42, 62 and 72, the dishes may nest very close to one another. That is, they may lie in surface to surface contact to provide minimum stack height so as to conserve space when stored and minimize shipping costs.

The sundae dish described above has many advantages. First, because the dish and cover are identical, manufacturing costs are reduced, as the same tools are used to produce both parts of the container. In addition, inventory requirements are reduced. And the containers are free of undercuts and nest naturally with one another so as to provide the maximum numbers of containers in a given stack height. Furthermore, the containers are very easy to blank from the sheet in which the containers are formed as the tabs and slots may be trimmed simultaneously with the blanking of the full container from the web. The invention is also very convenient for the fast food establishment that uses them. If the sundae made in the dish is to be eaten on the premises, the dish may be used alone without a mating cover. The tab and enlarged flange at the slot at opposite ends of the dish make it easy to carry. And if it is to be covered, that may be done quickly and conveniently because the two parts are self aligning. When the cover is inverted on the dish carrying the confection, the cooperation between the skirts, beads, and end walls quickly align the cover and dish together, and the tabs may be flexed through their mating slots to lock the dish closed.

With the benefit of the foregoing description, those skilled in the art will appreciate that numerous modifications may be made of this invention without departing from its spirit. Therefore, it is not intended to limit the scope of this invention to the single embodiment illustrated and described. Rather, its scope is to be determined by its appended claims and their equivalents.

What is claimed is:

1. A thin-walled plastic sundae dish adapted to mate with a second identical dish so that one may serve as a cover for the other comprising:

a bottom wall and an upstanding continuous side wall, an outwardly extending substantially horizontal flange attached to the top of the side wall about its periphery, upstanding first and second beads formed on the flange and each extending about approximately one half the periphery of the flange, said first and second beads being substantially a continuation of one another so that the two together extend about the full periphery of the flange, said second bead being positioned on the flange so that its inner side is disposed outwardly from the center of the dish beyond the outer side of the first bead, and a male latching member formed at one end of the flange as an extension of the first bead and a female latching member formed at the other end of the flange and interrupting the second bead whereby when two identical dishes are placed flange to flange with the male and female latching members of the two dishes registering with one another, the second bead of each dish lies outside the first bead of the other dish to form a skirt about the closed container formed by the two dishes and the male and female latching members are positioned to engage one another and hold the two dishes together.

2. A sundae dish as defined in claim 1 further characterized by end walls formed at each end of one of the beads for engaging the corresponding end walls of a second sundae dish inverted on it as a cover to align the two dishes with one another.

3. A thin-walled plastic sundae dish adapted to mate with a second identical dish so that one may serve as a cover for the other comprising:

a bottom wall and a surrounding, continuous, upwardly flared, side wall, an outwardly extending horizontal flange provided about the top of the side wall, a bead extending upwardly from the edge of the flange about no more than half the circumference of the dish, a skirt extending upwardly from the edge of the flange about no more than half the dish and radially beyond the bead, said skirt being circumferentially displaced from the bead so as not to circumferentially overlap it, whereby when two such dishes are placed face to face and one reversed with respect to the other, the bead of each dish bears against the flange of the other dish and the skirt of each dish lies outside the bead of the other dish to form a protective rim for the assembled dishes, and latching means provided at the periphery of the dish for releasably locking two such dishes together, said latching means comprising a first member extending outwardly from the plane of the top of the bead and a second member extending outwardly from the plane of the flange, said members forming the two parts of the latching means so that when two dishes are reversed and engage one another as dish and cover, the members may lock the two together.

4. A sundae dish as defined in claim 1 further characterized by:

the male latching member being a tab in the plane of the top of the first bead and the female latching member being a dove-tailed slot in the plane of the flange.

5. A sundae dish as defined in claim 3 further characterized by the first latching member being a tab and the second member being a slot sized to receive the tab.

6. A sundae dish as defined in claim 5 further characterized by one of the bead and skirt extending about one half of the circumference of the flange, and an end wall provided at least at one end of the bead or skirt for engaging the opposite end of the like bead or skirt of a second dish to align the dishes with one another.

7. A sundae dish as defined in claim 5 further characterized by the bead being continuous and extending about one half of the circumferencce of the flange so that when two dishes are mated, the beads of the two form a continuous bead about the container.

* * * * *